US012564273B1

(12) United States Patent
Sun

(10) Patent No.: US 12,564,273 B1
(45) Date of Patent: Mar. 3, 2026

(54) SOFA BARRIER

(71) Applicant: Wei-Tao Sun, Suzhou City (CN)

(72) Inventor: Wei-Tao Sun, Suzhou City (CN)

(73) Assignee: Suzhou Zewo Import Export Co., Ltd.

( * ) Notice: Subject to any disclaimer, the term of this patent is extended or adjusted under 35 U.S.C. 154(b) by 29 days.

(21) Appl. No.: 18/931,095

(22) Filed: Oct. 30, 2024

(51) Int. Cl.
*A47C 31/00* (2006.01)
*A44B 11/25* (2006.01)
*A47B 95/00* (2006.01)

(52) U.S. Cl.
CPC ..... *A47C 31/00* (2013.01); *A44B 11/258* (2013.01); *A47B 2095/004* (2013.01)

(58) Field of Classification Search
CPC ..... A47C 31/00; A44B 11/258; A47B 95/043; A47B 2095/004
USPC ..... 5/12.1; 297/463.2
See application file for complete search history.

(56) References Cited

U.S. PATENT DOCUMENTS 3,695,690 A * 10/1972 Carson ..... A47C 31/11 297/DIG. 6
3,779,624 A * 12/1973 Werderitsch ..... A47B 95/043 312/278
4,323,610 A * 4/1982 Leverich ..... A47B 95/043 428/36.1
5,540,480 A * 7/1996 Christa ..... A47C 31/11 5/493
6,367,423 B1 * 4/2002 Scheuer ..... A01M 29/30 297/219.1
7,316,388 B2 * 1/2008 Prismall ..... E01F 13/028 256/45
D603,192 S * 11/2009 Priddle ..... D6/702
7,805,781 B1 * 10/2010 Smith ..... A47C 17/86 5/663
8,127,379 B2 * 3/2012 Hardee ..... A47G 9/0253 24/399
8,205,281 B2 * 6/2012 Swierski ..... A47G 29/08 297/188.2
D666,308 S * 8/2012 Sanchez ..... D25/48.8
8,465,101 B1 * 6/2013 Alvarez ..... A47B 97/00 297/463.2
9,241,567 B1 * 1/2016 Davis ..... A47B 95/002
D779,679 S * 2/2017 Sartain ..... D25/48.5
D792,143 S * 7/2017 Caron ..... D6/719
11,470,979 B1 * 10/2022 Madsen ..... A01M 29/30
11,517,119 B1 * 12/2022 Madsen ..... A01M 29/30
2003/0222552 A1 * 12/2003 Wessel ..... A47B 95/002 312/278
2005/0103964 A1 * 5/2005 Baechle ..... D06F 39/001 248/678

(Continued)

*Primary Examiner* — Myles A Throop

(57) ABSTRACT

The present invention provides a sofa barrier, suitable for the horizontal gap between a sofa base and a floor, comprising at least one elongated panel-shaped barrier panel, horizontally positioned to effectively prevent objects or pets from entering beneath the sofa. The core technology lies in a male-female buckle, including a male buckle, a female buckle, a plug, and a slot, which secure the barrier panel in place between the sofa base and the floor through tight interlocking. This ensures stability during daily use, making it resistant to loosening or collapsing. This design does not require the use of glue, avoiding damage to the floor surface, and offers high stability and durability, making it difficult for pets to destroy.

8 Claims, 11 Drawing Sheets

(56) References Cited

U.S. PATENT DOCUMENTS

| | | | | |
|---|---|---|---|---|
| 2009/0174248 | A1* | 7/2009 | Chisholm | A01K 1/035<br>297/463.2 |
| 2011/0209838 | A1* | 9/2011 | Santora | A47B 95/00<br>160/368.1 |
| 2012/0315434 | A1* | 12/2012 | Marler | A47C 17/86<br>428/121 |
| 2013/0019410 | A1* | 1/2013 | Willis | A47C 31/00<br>5/663 |
| 2016/0100695 | A1* | 4/2016 | Harris | A47C 31/00<br>428/12 |
| 2016/0220029 | A1* | 8/2016 | Caron | A47C 17/86 |
| 2016/0270550 | A1* | 9/2016 | Oleksa | A01K 1/035 |
| 2017/0290445 | A1* | 10/2017 | Cerri, III | A47D 15/00 |
| 2019/0261784 | A1* | 8/2019 | Serenson | A47C 19/22 |

* cited by examiner

SOFA BARRIER

BACKGROUND OF THE INVENTION

Fields of the Invention

The present invention relates to a household product and, more particularly, to a sofa barrier.

Descriptions of Related Art

When family members, including pets or toddlers, engage in activities and play around the sofa, many small objects such as toys and household items often scatter across the floor. These small objects can easily enter beneath the sofa base, leading to problems. For example, a toddler may attempt to retrieve an object, but due to the narrow space beneath the sofa, their limbs could easily become trapped. Additionally, when a pet dog's toy ball rolls under the sofa base, the dog often barks continuously to get the owner's attention, seeking help to retrieve the small objects.

Similarly, because the space under the sofa base is narrow, a pet cat may hide there for extended periods, reducing its interaction time with the owner. In the case of reptile pets, they may accidentally enter beneath the sofa during free roaming. Since it is difficult to lure reptiles out and they cannot easily escape on their own, the owner may need to frequently block their path and may also face the issue of reptiles defecating under the sofa.

Current sofa barrier products include L-shaped adhesive panels, where one side is glued to the floor and the other side is used to block toys, but the adhesive can easily damage the floor. Another product, a blocking strip, uses a stretchable fabric strap fixed between the sofa legs, but it lacks stability and pets may damage this material. Therefore, existing products have shortcomings such as causing damage to the floor or lacking sufficient stability.

SUMMARY OF THE INVENTION

The present invention provides a sofa barrier that will not damage a floor and has good stability.

The sofa barrier of the present invention is applicable to the horizontal gap between a sofa base and a floor and comprises at least one barrier panel and a male-female buckle. The barrier panel is elongated and horizontally positioned. The male-female buckle includes a male buckle, a female buckle, at least one plug, and at least one slot. The bottom surfaces of the male buckle and the female buckle can be placed on the floor. The plug is fixed to the male buckle, and the slot is formed on the female buckle. In an assembled state, the barrier panel is positioned between the male buckle and the female buckle, and the plug is inserted into and locked with the slot.

As described above, the present invention provides an improved design for a sofa barrier, effectively addressing the shortcomings of existing products that either damage the floor or lack stability. The present invention uses a stable elongated barrier panel that is not easily damaged by pets and can be horizontally placed in the gap between the sofa base and the floor, preventing toys, household items, or pets from entering. The core technology of the present invention lies in its stable male-female buckle, which includes a male buckle, a female buckle, at least one plug, and at least one slot. The male-female buckle secures the barrier panel between the sofa base and the floor. Both the male and female buckles are placed on the floor with their bottom surfaces facing down, and the tight interlocking between the plug and the slot ensures that the barrier panel remains stable during daily use, making it resistant to loosening or collapsing. Additionally, no glue or other adhesives are required in the present invention, which prevents damage to the floor's surface and effectively addresses the issues associated with traditional adhesive barriers.

In the present invention, the barrier panel can be provided with at least one through hole, and the plug, in the assembled state, passes through the through hole of the barrier panel.

In the present invention, the slot can be designed as a through-slot, and the plug can be provided with a protrusion that fits with the slot.

In the present invention, during the insertion of the plug into the slot, the protrusion can be compressed by edges of the slot, causing the plug to elastically deform; and once the plug is fully inserted into the slot to achieve the assembled state, the plug can return to its original shape, with the protrusion snapping securely against the rear edge of the slot, which is positioned away from the male buckle.

In the present invention, when the bottom edge of the barrier panel contacts and abuts against the floor, the top edge of the barrier panel may be positioned close to a sofa base.

In the present invention, the slot can be vertically oriented; the at least one plug can be present in a quantity double that of the at least one slot; the at least one plug can be paired, with each plug pair defined by every two plugs; the plug pairs can be arranged in an upper and lower configuration and inserted into the upper and lower ends of the slot, respectively; and the through hole can be vertically oriented to correspond to the slot.

In the present invention, the at least one barrier panel can be present in a quantity of two; the at least one through hole can be present in a quantity of two disposed at the left end and the right end of the respective barrier panel, respectively; and the plug can pass through the through hole at the left end of one barrier panel and the through hole at the right end of another barrier panel and be inserted into and locked with the slot.

In the present invention, the sofa barrier can further comprise a strap, and the barrier panel can be provided with a plurality of through holes, so that the strap can pass through the through holes to fasten the barrier panel to a sofa leg.

DETAILED DESCRIPTION OF THE PREFERRED EMBODIMENT

Figure 1:
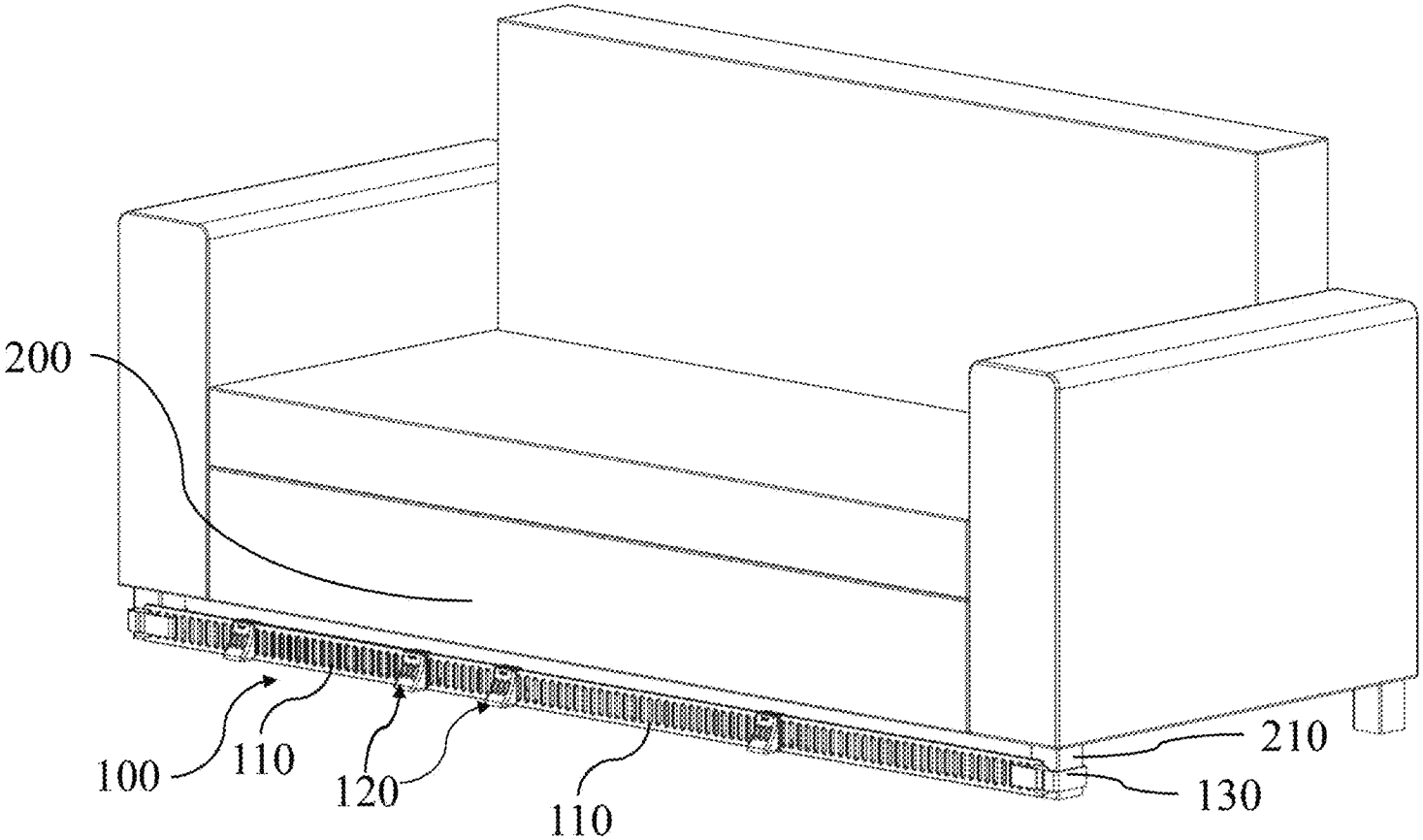
FIG. 1 is an actual application schematic view of the present invention.
Figure 2:
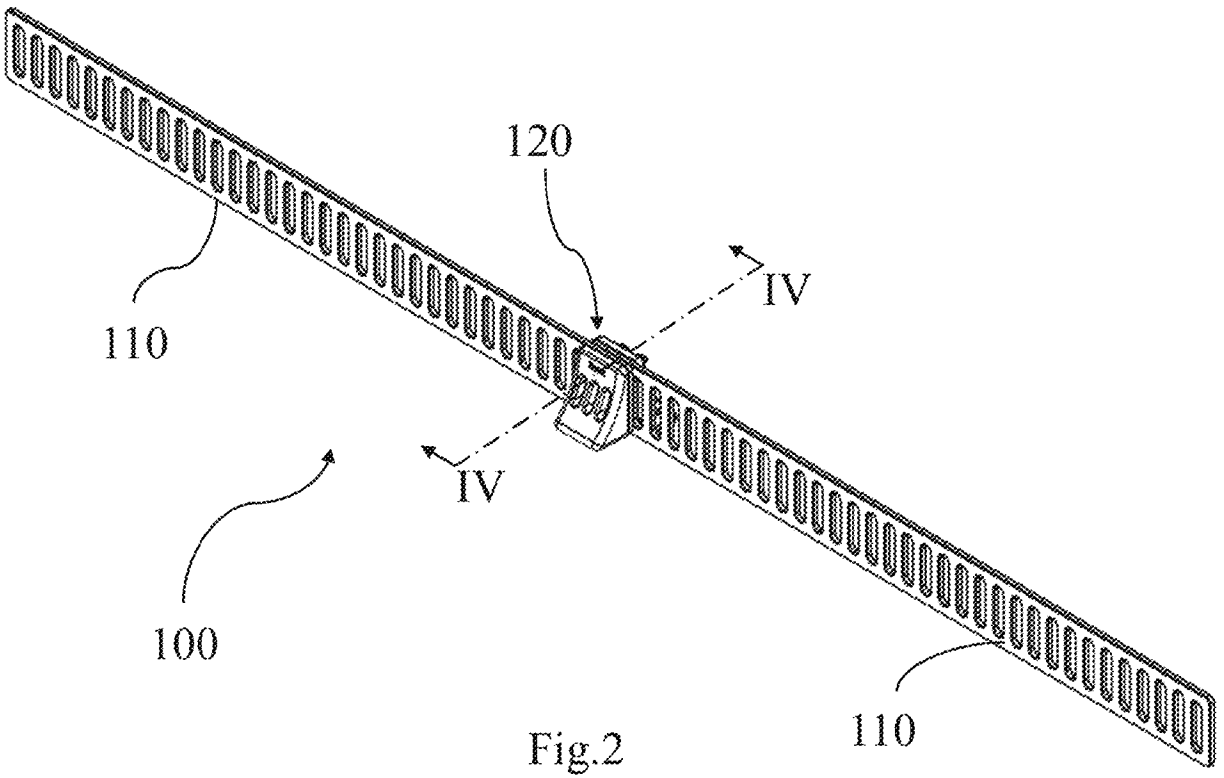
FIG. 2 is a perspective schematic view of the present invention.

Referring to FIGS. 1 and 2, in some embodiments, the present invention provides a sofa barrier 100, applicable to a horizontal gap between a sofa base 200 and a floor. The sofa barrier 100 includes at least one barrier panel 110 and a male-female buckle 120. It is designed to fill the gap between the sofa base 200 and the floor, effectively preventing small objects or pets from entering the bottom of the sofa, thereby improving household safety and cleanliness.

The barrier panel 110 is elongated and horizontally positioned and can be made from rigid plastic, such as polyvinyl chloride (PVC), which resists pet bites and external damage, increasing its stability and reducing maintenance needs.

Figure 3:
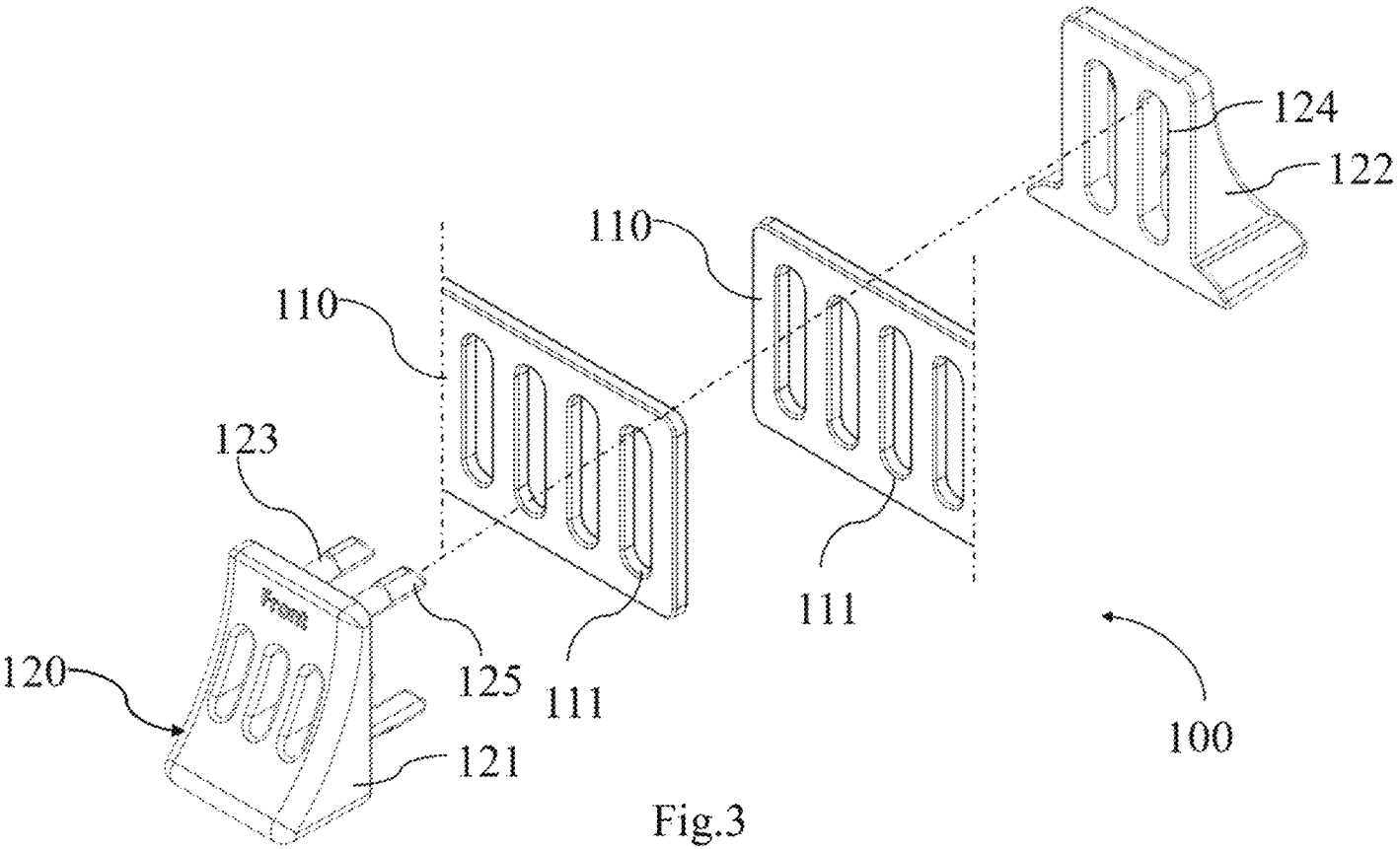
FIG. 3 is a partial exploded perspective schematic view of the present invention.
Figure 4:
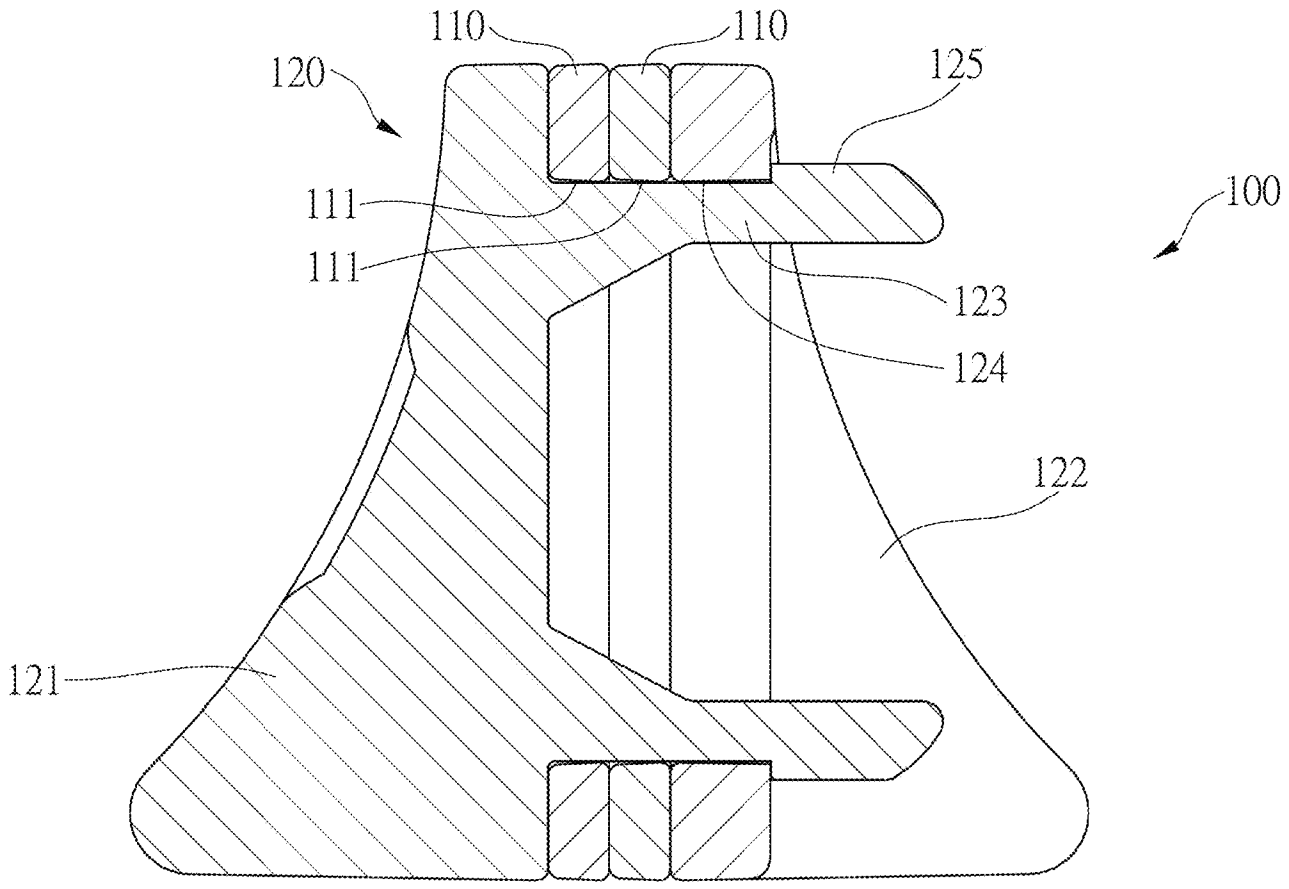
FIG. 4 is a cross-sectional schematic view taken along line IV-IV of FIG. 2.

Referring to FIGS. 3 and 4, the male-female buckle 120 includes a male buckle 121, a female buckle 122, at least one plug 123, and at least one slot 124. The bottom surfaces of the male buckle 121 and the female buckle 122 are placed on the floor, forming a stable base. The plug 123 is fixed to the male buckle 121, and the slot 124 is formed on the female buckle 122. The male-female buckle 120 can also be made from rigid plastic, such as PVC. Both the male buckle 121 and the female buckle 122 have sufficient contact area with the floor to increase friction, effectively preventing tipping. In the assembled state, the barrier panel 110 is positioned between the male buckle 121 and the female buckle 122, and the plug 123 is inserted into the slot 124. The height of the barrier panel 110 can be designed to approximately match the height of the sofa base 200 to ensure effective blocking. For example, the height can be designed at 1.6 inches to help block small objects from entering beneath the sofa base 200.

The male-female buckle 120 may include vertical slots 124 in a quantity of two, with plugs 123 in a quantity of two inserted into the upper and lower ends of each slot 124. The design of multiple plugs 123 further enhances the stability of the barrier panel 110, ensuring that it remains secure during daily use.

Alternatively, the male-female buckle 120 may include a plug 123 in a quantity of one and a slot 124 in a quantity of one, which can still effectively secure the barrier panel 110.

The sofa barrier 100 of the present invention is not only suitable for sofa bases 200 but can also be widely applied to other furniture with low bases. In particular, some modern furniture is designed with low bases to accommodate robotic vacuum cleaners, such as coffee tables, wardrobes, shoe cabinets, cupboards and the like. By using the sofa barrier 100 of the present invention, it can effectively block access and maintain household safety and cleanliness.

Referring to FIGS. 3 and 4, in some embodiments, at least one through hole 111 is formed on the barrier panel 110. In the assembled state, the plug 123 passes through the through hole 111 of the barrier panel 110. This design makes the connection between the plug 123 and the slot 124 more stable, thereby enhancing the overall stability of the sofa barrier 100 and preventing loosening due to external forces or long-term use.

In other embodiments, the barrier panel 110 may not have a through hole 111. In such cases, the plug 123 is inserted into the slot 124 from the top or bottom of the barrier panel 110. In these embodiments where the plug 123 passes through the through hole 111 of the barrier panel 110 and then is inserted into the slot 124, the tightness and stability of the connection between the male-female buckle 120 and the barrier panel 110 is further enhanced, making the sofa barrier 100 more stable during daily use.

Referring to FIGS. 3 and 4, in some embodiments, a protrusion 125 is provided on the plug 123, and the slot 124 is designed as a through-slot. The protrusion 125 fits with the slot 124 to ensure a secure lock between the plug 123 and the slot 124 after insertion, enhancing the structural stability of the sofa barrier 100.

During the insertion of the plug 123 into the slot 124, the protrusion 125 is compressed by the edges of the slot 124, causing the plug 123 to elastically deform. During this process, the plug 123 moves smoothly within the slot 124 until the insertion is complete. Once the plug 123 is fully inserted into the slot 124 to achieve the assembled state, it returns to its original shape, with the protrusion 125 snapping securely against the rear edge of the slot 124, away from the male buckle 121. This creates a firm locking effect, effectively enhancing the tightness and stability of the assembly, preventing the male buckle 121 and the female buckle 122 from loosening due to vibrations or external forces. This ensures that the sofa barrier 100 remains stable during long-term use.

Referring to FIGS. 3 and 4, in some embodiments, the slot 124 is vertically oriented, and the quantity of plugs 123 is double the quantity of slots 124. The plugs 123 are paired, with each plug pair defined by every two plugs 123. The plug pairs are arranged in an upper and lower configuration and inserted into the upper and lower ends of the slot 124, respectively. The through hole 111 is vertically oriented to correspond to the slot 124. For the plug 123 inserted into the upper end of the slot 124, its corresponding protrusion 125 extends upward, ensuring a tight fit with the upper edge of the slot 124. Conversely, for the plug 123 inserted into the lower end of the slot 124, its corresponding protrusion 125 extends downward. It is worth noting that the protrusion 125 can also extend to the left or right, while still providing a firm locking effect. Regardless of the direction of the protrusion 125, its primary function is to enhance the stability between the plug 123 and the slot 124.

In other embodiments, the slot 124 can be designed as a horizontal slot, with each slot 124 corresponding to two plugs 123 to increase connection stability. Additionally, the slot 124 can be designed as a rounded rectangular shape (similar to a racetrack-like shape), specifically accommodating a single plug 123 while leaving sufficient clearance for the plug 123 to elastically deform during insertion. Furthermore, the slot 124 can also be oriented vertically, with each slot 124 accommodating a plurality of plugs 123.

Figure 5A:
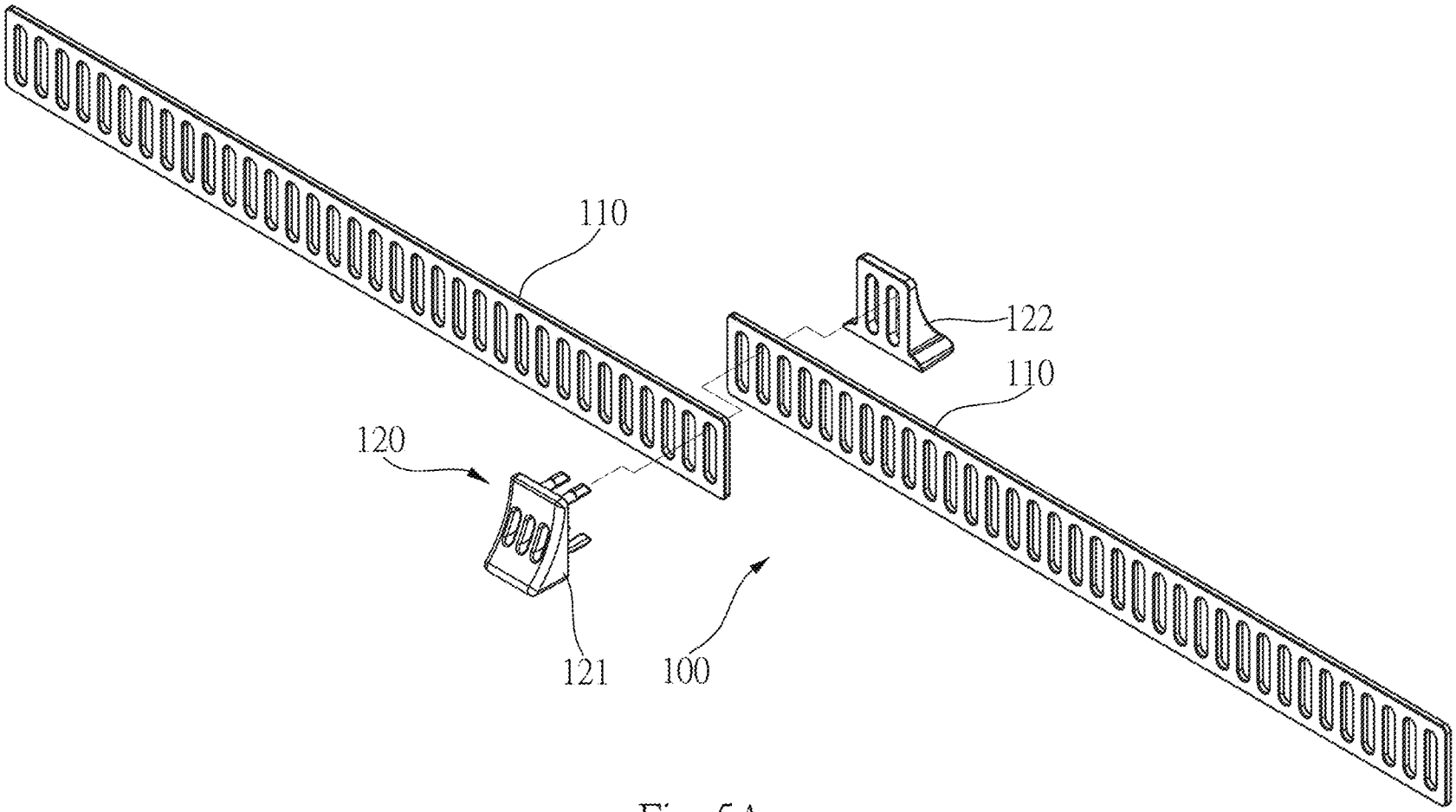
FIG. 5A is an exploded schematic view of the present invention.
Figure 5B:
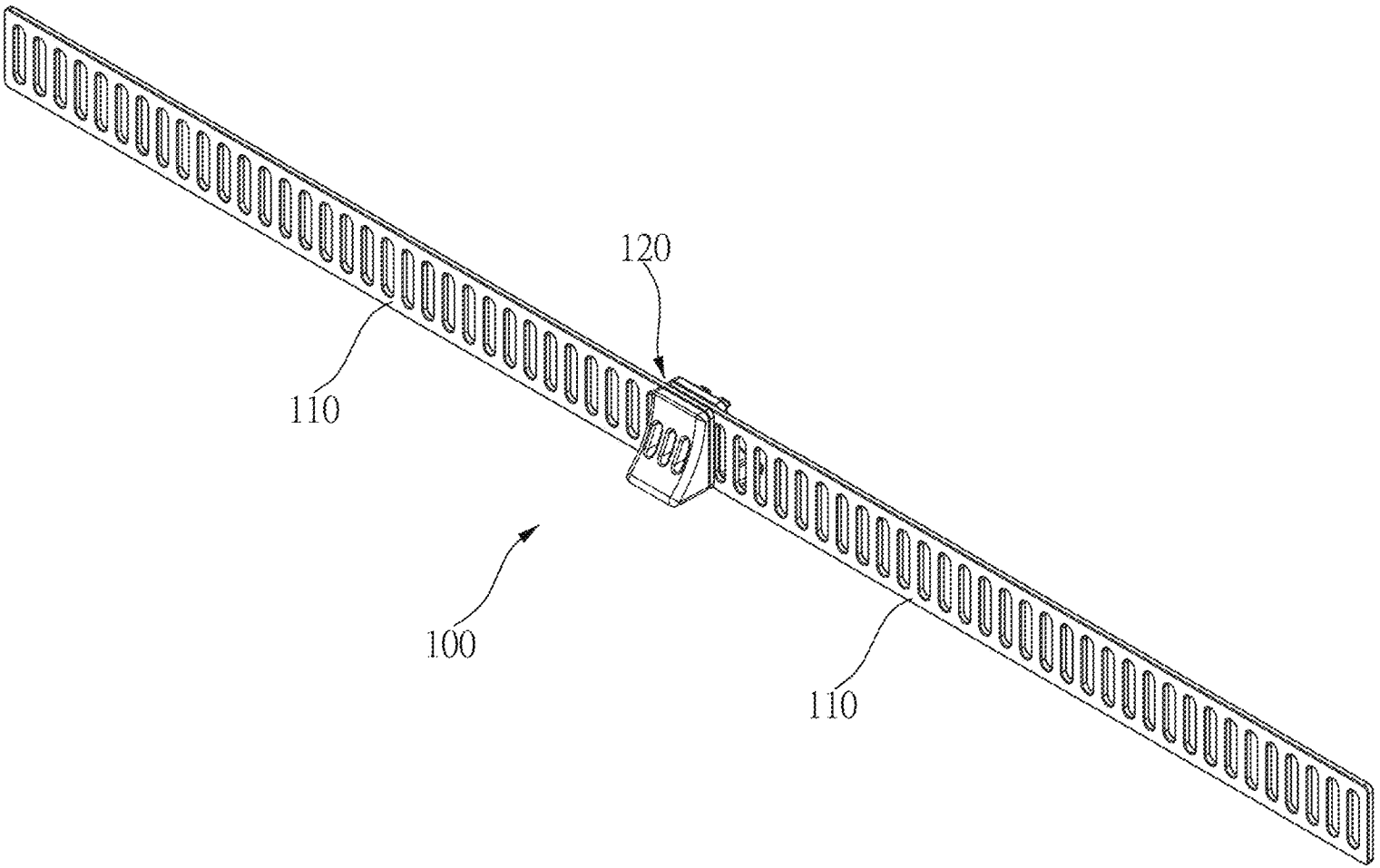
FIG. 5B is an assembled schematic view of FIG. 5A.

Referring to FIGS. 5A and 5B, in some embodiments, there are barrier panels 110 in a quantity of two, and each of the barrier panels 110 has through holes 111 in a quantity of at least two. The at least two through holes 111 are located at the left and right ends of the barrier panel 110, respectively. The plug 123 passes through the left-end through hole 111 of one barrier panel 110 and the right-end through hole 111 of another barrier panel 110 before being inserted into the slot 124. In this assembled state, even if the number of through holes 111 is small, a firm connection can still be achieved. It should be noted that the left end of one barrier panel 110 can optionally overlap the right end of another barrier panel 110, or the left and right ends may interface simply without overlapping. If the overlapping or interfacing of the left and right ends results in a thickness that is doubled, the relative distance between the protrusion 125 and the male buckle 121 should be adjusted accordingly to ensure that the barrier panels 110 are securely clamped between the male buckle 121 and the female buckle 122, ensuring the stability and effectiveness of the overall structure.

Figure 6A:
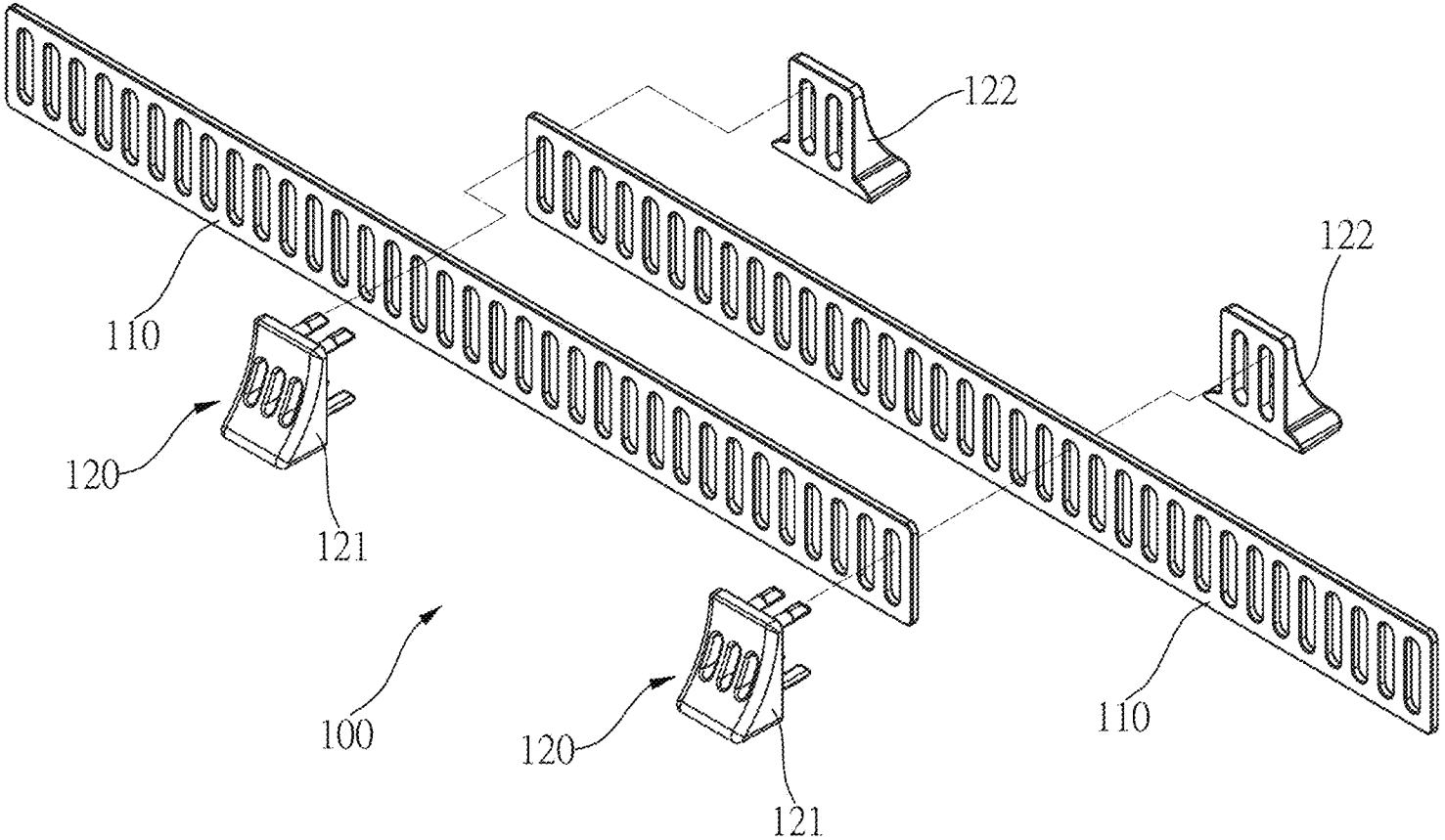
FIG. 6A is an exploded schematic view of the present invention.
Figure 6B:
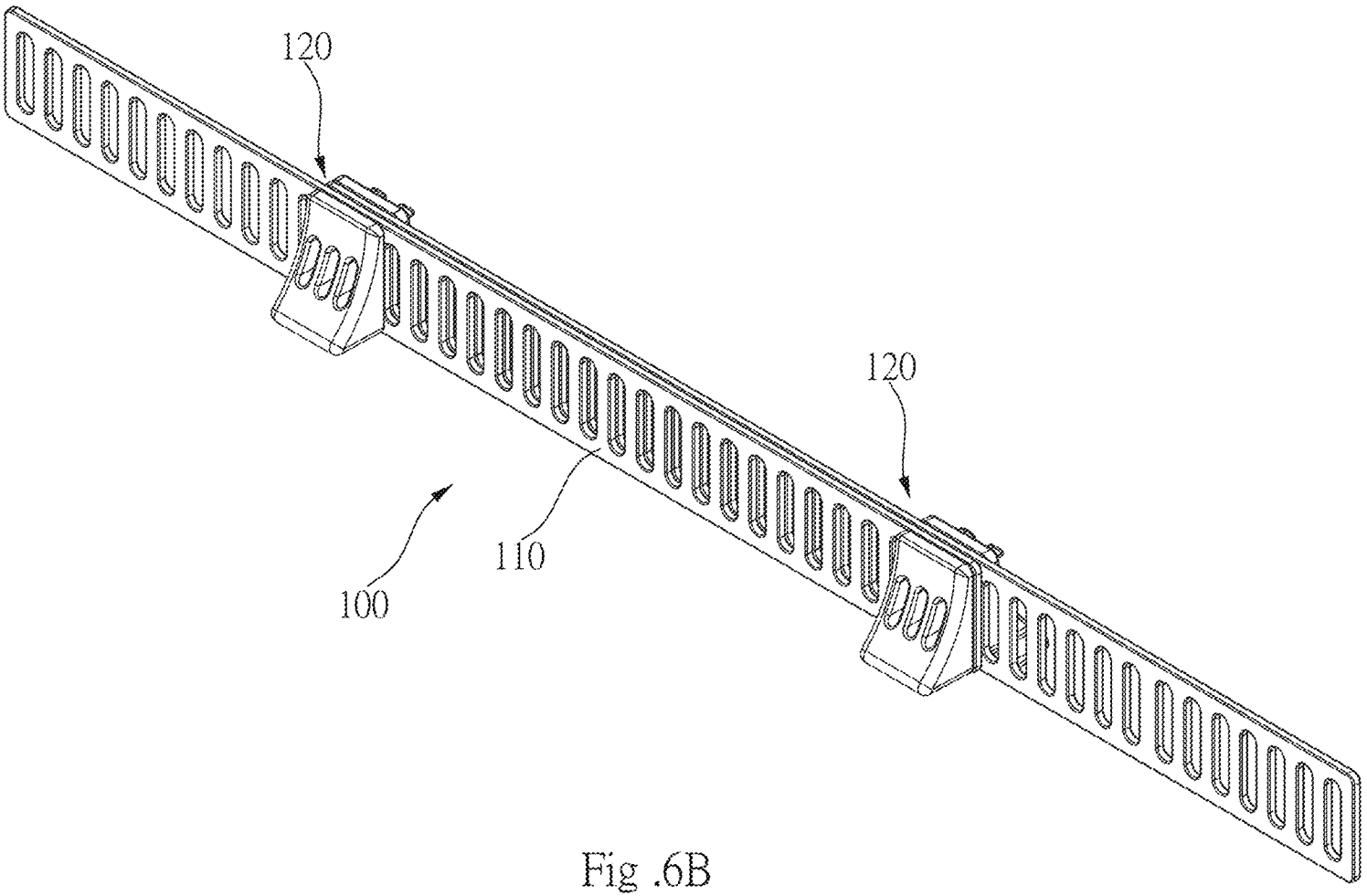
FIG. 6B is an assembled schematic view of FIG. 6A.

Referring to FIGS. 6A and 6B, in some embodiments, the barrier panels 110 are provided with through holes 111 that are evenly spaced. In the assembled state, one barrier panel 110 can overlap another barrier panel 110 over a large area, and flexible adjustment of the combined length of the barrier panels 110 is enabled using these through holes 111 to accommodate different lengths of sofa bases 200. Additionally, in areas where the structure of the barrier panels 110 is relatively weak, more overlapping can be applied to further enhance the overall stability.

Figure 7A:
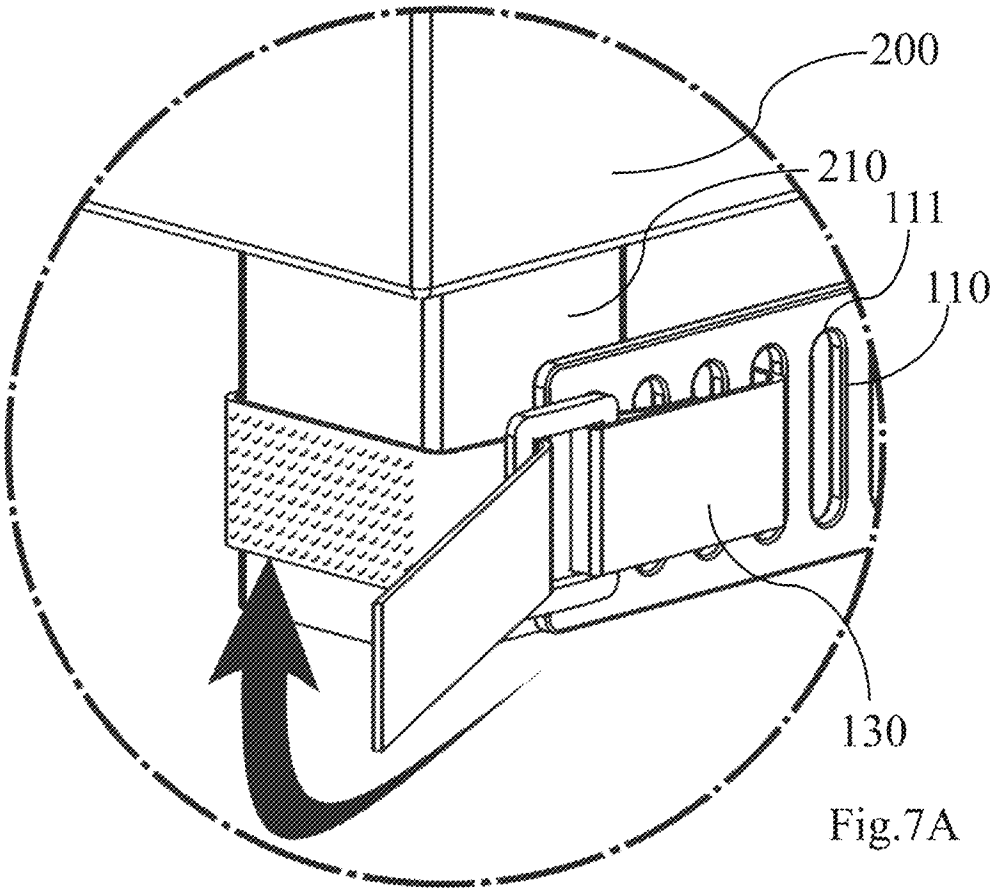
FIG. 7A is a partial perspective schematic view of the present invention.
Figure 7B:
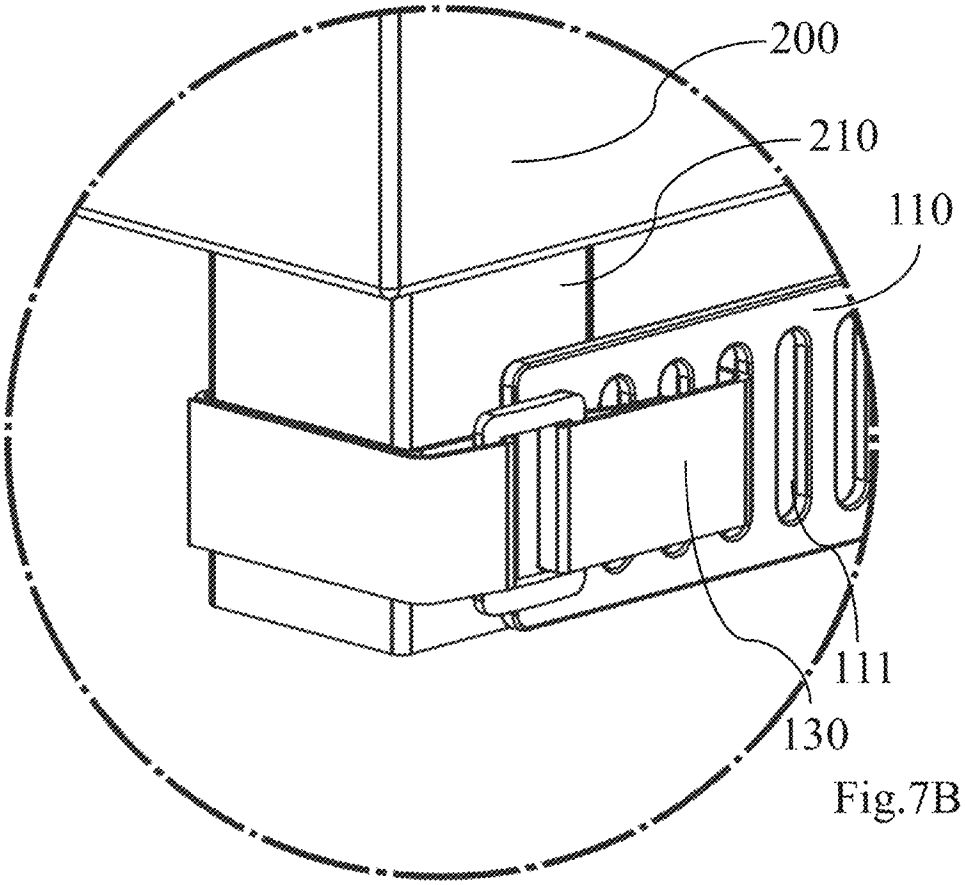
FIG. 7B is a partial perspective schematic view of the present invention.

Referring to FIGS. 7A and 7B, in some embodiments, the sofa barrier of the present invention may further include a strap 130. Multiple through holes 111 are provided on the barrier panel 110, and the strap 130 passes through these through holes 111 to fasten the barrier panel 110 to a sofa leg 210. The shape of the through holes 111 is designed to facilitate the threading and securing of the strap 130, thereby effectively enhancing the connection between the barrier panel 110 and the sofa leg 210. By using the strap 130 to firmly fix the barrier panel 110 to the sofa leg 210, displacement is prevented.

Figure 8:
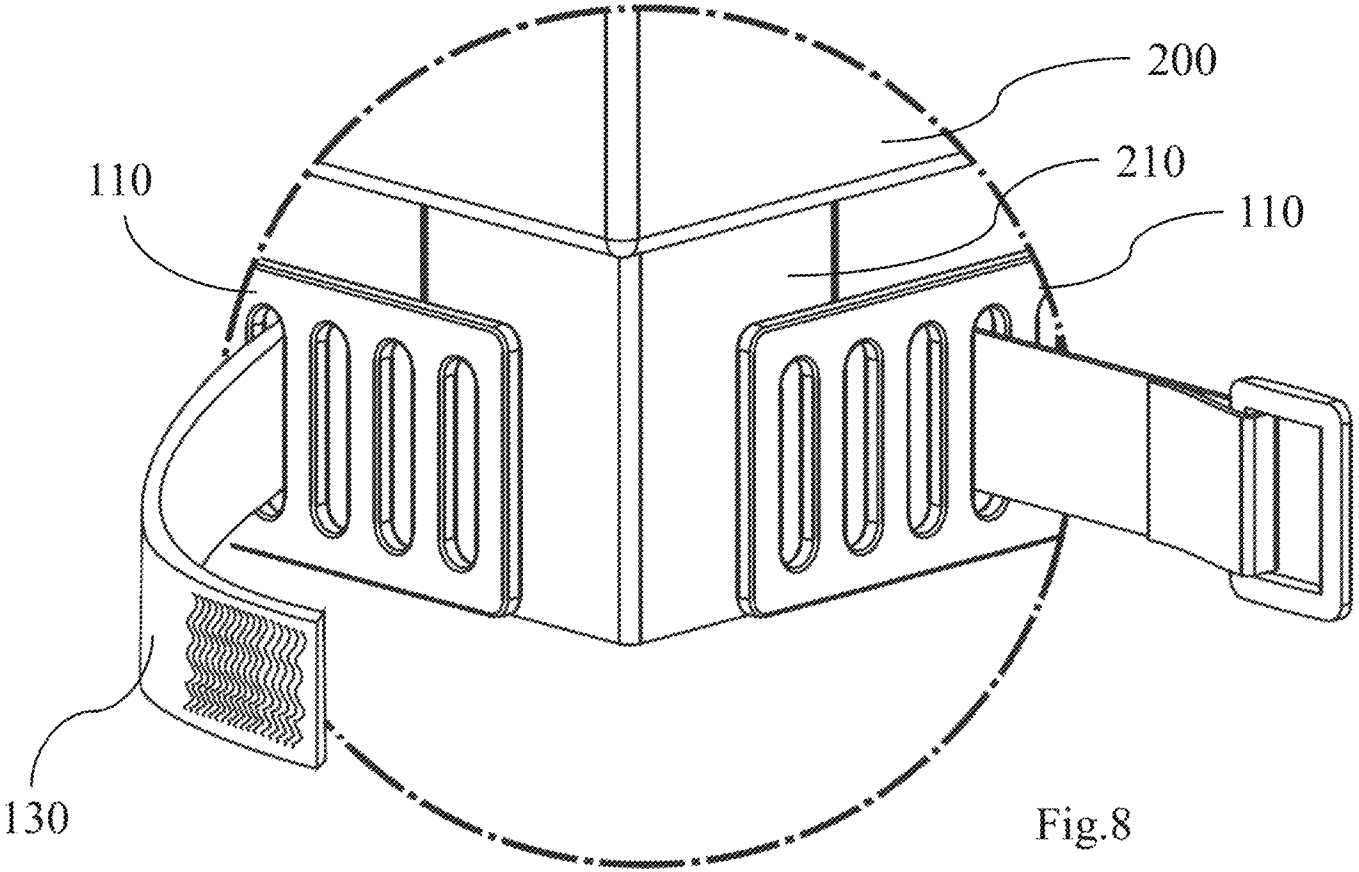
FIG. 8 is a partial perspective schematic view of the present invention.

Referring to FIG. 8, at the corner of a sofa, two orthogonally arranged barrier panels 110 can be securely fastened with the strap 130. This configuration is also suitable for L-shaped sofas, where the strap 130 can provide additional fastening at the inner corner of the sofa leg 210, meeting the demands of various home environments.

The advantages of the present invention are as follows:

I. The sofa barrier 100 of the present invention is designed to fill the gap between the sofa base 200 and the floor, effectively preventing small objects, pets, or toddlers from entering under the sofa. This enhances home safety and reduces the need for cleaning.

II. The barrier panel 110 is made of rigid plastic material to resist chewing by pets, improving the overall structural stability. Additionally, the male-female buckle 120 ensure that the barrier panel 110 remains secure and does not collapse or loosen during use, guaranteeing long-term durability.

III. Through the multiple through holes 111 and the strap 130, the combined length of the barrier panels 110 can be easily adjusted. The strap 130 can be flexibly applied at corners, adapting to various home environments.

What is claimed is:

1. A sofa barrier applicable to a horizontal gap between a sofa base and a floor, the sofa barrier comprising:

at least one barrier panel that is elongated and horizontally positioned; and a male-female buckle that includes a male buckle, a female buckle, at least one plug, and at least one slot, wherein bottom surfaces of the male buckle and the female buckle are configured for placement on the floor, the at least one plug is fixed to the male buckle, and the at least one slot is formed on the female buckle, wherein in an assembled state, the barrier panel is positioned between the male buckle and the female buckle, and the at least one plug is inserted into and locked with the at least one slot.

2. The sofa barrier as claimed in claim 1, wherein the barrier panel is provided with at least one through hole, and the at least one plug, in the assembled state, passes through the at least one through hole of the barrier panel.

3. The sofa barrier as claimed in claim 2, wherein the at least one plug is provided with a protrusion, the at least one slot is designed as a through-slot, and the protrusion fits with the at least one slot.

4. The sofa barrier as claimed in claim 3, wherein during insertion of the at least one plug into the at least one slot, the protrusion is compressed by edges of the at least one slot, causing the at least one plug to elastically deform; and once the insertion of the at least one plug into the at least one slot is accomplished to achieve the assembled state, the at least one plug returns to an original shape thereof, with the protrusion correspondingly snapping against a rear edge, away from the male buckle, of the at least one slot.

5. The sofa barrier claimed in claim 2, wherein when a bottom edge of the barrier panel contacts and abuts against the floor, a top edge of the barrier panel is positioned close to a sofa base.

6. The sofa barrier claimed in claim 2, wherein the at least one slot is vertically oriented; the at least one plug is present in a quantity double that of the at least one slot; the at least one plug is paired, with plug pairs each defined by every two of the at least one plug; the plug pairs are arranged in an upper and lower configuration and inserted into upper and lower ends of the at least one slot, respectively; and the at least one through hole is vertically oriented to correspond to the at least one slot.

7. The sofa barrier claimed in claim 2, wherein the at least one barrier panel is present in a quantity of two; the at least one through hole is present in a quantity of two disposed at a left end and a right end of a respective one of the at least one barrier panel, respectively; and the least one plug passes through the through hole at the left end of one of the barrier panels and the through hole at the right end of another one of the barrier panels and is inserted into and locked with the least one slot.

8. The sofa barrier claimed in claim 2, further comprising a strap, wherein the least one barrier panel is provided with a plurality of through holes, and the strap passes through the through holes to fasten the at least one barrier panel to a sofa leg.

* * * * *